US005167523A

United States Patent [19]

Crimmins et al.

[11] Patent Number: 5,167,523

[45] Date of Patent: Dec. 1, 1992

[54] ELECTRICAL CONNECTOR

[75] Inventors: James Crimmins, Wilton, Conn.; Raymond J. Kallio, Jr., Rye Brook, N.Y.

[73] Assignee: Harbor Electronics, Inc., Ridgefield, Conn.

[21] Appl. No.: 786,561

[22] Filed: Nov. 1, 1991

[51] Int. Cl.[5] ..... H01R 13/627

[52] U.S. Cl. ..... 439/350; 439/610; 439/358

[58] Field of Search ..... 439/350-358, 439/108, 607-610

[56] References Cited

U.S. PATENT DOCUMENTS

| | | | |
|---|---|---|---|
| 2,760,174 | 8/1956 | Burtt et al. | 339/91 |
| 3,566,336 | 2/1971 | Johnson | 339/91 |
| 3,828,302 | 8/1974 | Cieniawa et al. | 339/91 |
| 4,367,005 | 1/1983 | Douty et al. | 339/107 |
| 4,455,058 | 6/1984 | Harner et al. | 339/99 |
| 4,621,885 | 11/1986 | Szczesny et al. | 339/91 |
| 4,678,256 | 7/1987 | Nishino et al. | 439/347 |
| 4,699,438 | 10/1987 | Kikuta | 439/95 |
| 4,702,542 | 10/1987 | Noyes | 439/347 |
| 4,726,783 | 2/1988 | Nakazawa et al. | 439/350 |
| 4,762,505 | 9/1988 | Arick et al. | 439/347 |
| 4,772,212 | 9/1988 | Sotolongo | 439/98 |
| 4,838,808 | 6/1989 | Fujiura | 439/437 |
| 4,838,810 | 6/1989 | Yoshimura et al. | 439/358 |
| 4,838,812 | 6/1989 | Yoshimura et al. | 439/610 |
| 4,889,503 | 12/1989 | Philippson et al. | 439/610 |
| 4,923,409 | 5/1990 | Ishii | 439/358 |
| 4,941,849 | 7/1990 | Fujiura | 439/610 |
| 4,961,711 | 10/1990 | Fujiura et al. | 439/357 |
| 5,011,424 | 4/1991 | Simmons | 439/352 |
| 5,011,425 | 4/1991 | Van Zanten et al. | 439/353 |

*Primary Examiner*—Neil Abrams
*Assistant Examiner*—Hien D. Vu
*Attorney, Agent, or Firm*—St. Onge Steward Johnston & Reens

[57] ABSTRACT

An electrical computer cable connector that has high strength and resistance to twisting forces includes a housing and latching arms located along lateral sides of the housing. The latching arms have engaging ends for engaging a complementary electrical connector, actuator ends for finger grasping to move the engaging ends of the latching arms about a pivot point, and spring arms to give a spring action to the latching arms. The latching arms are formed of relatively thick gauge metal to prevent bending or deformation of the engaging ends, and resist separation forces of at least 50 pounds. A housing cover fits over the housing and latching arms.

22 Claims, 5 Drawing Sheets 102
108
108
58
28
58
10
94
102
98
20
44
68
26
24
68
42
42
44
64
64
32
50
50
26
59
36
30
52
52
54
54
57
34
40
56
59
57

108
102
108
58
58
28
94
E
26
20
102
10
98
50
24
26
68
60
44
68
42
42
44
64
64
32
32
50
30
59
36
59
52
52
57
54
54
34
56
40
57

ELECTRICAL CONNECTOR

BACKGROUND OF THE INVENTION

1. Field of the Invention

The present invention relates to shielded electrical connectors of the type used to connect together with a mating electrical connector. Such connectors are typically used to connect a multiple wire computer cable to a computer, computer peripheral or to another such cable.

2. Background of the Invention

Many latching electrical connectors have been proposed. However, these latching mechanisms have been characterized by a limited holding power, particularly when subject to twisting separating forces and other forces which pull the latching mechanisms other than linearly apart. For example, the latching mechanisms such as disclosed in Simmons, U.S. Pat. No. 5,011,424; Kikuta, U.S. Pat. No. 4,699,438; Fujiiura, U.S. Pat. No. 4,961,711; Nakazawa, U.S. Pat. No. 4,726,783; and Yoshimura, U.S. Pat. No. 4,838,810 are all formed of a stamped sheet metal, and would be likely to give way when subject to substantial pull apart forces, or oblique or twisting pull-apart forces.

A partial view of a prior art latching mechanism is shown in a connector with its cover removed in FIG. 13. This shows a prior art latching arm 500 formed of thin stamped sheet metal. Latching arm 500 has a latching end 502 of sheet metal, and a springy arm 504. Latching arm 500 is rotatable about opposing semicircular elements 506, 508 which are punched from the sheet metal arm 500 and which seat into a round hole 510 in the connector body 512. Connector body 512 is cast of metal and has a slot 514 on each lateral side to receive the sheet metal latching arms 500. This slot 514 retains the latching arm and prevents it from moving beyond a certain range of movement. The slot is necessary otherwise the thin sheet metal latching arms will deform under force and may become ineffective to securely latch the connector.

It would be desirable to provide a shielded latching electrical connector which has a substantial strength to retain the connector together with a mating connector even where there are oblique or twisting forces that might loosen a connector, and which is capable of maintaining a connection even when subjected to substantial pull-apart forces. These problems are addressed and resolved by the present invention as set forth hereafter.

SUMMARY OF THE INVENTION

It is an object of the invention to provide an electrical connector having a substantial retaining strength. It is an object of the invention to provide such a connector that can maintain a connection despite substantial pull-apart forces. It is a further object of the invention to provide a connector suited to resist separation when subjected to twisting forces. It is a further object of the invention to provide such an electrical connector which is easily operable to connect and disconnect the connector.

These objects, and other objects which will become apparent from the description that follows, are achieved by an electrical connector generally comprising a housing having a cable receiving end and a connector receiving end; and relatively heavy guage metal latching arms located along lateral sides of the housing.

The latching arms have engaging ends with hooking tabs for engaging a complementary electrical connector, and actuator ends for finger grasping to actuate movement of the engaging ends of the latching arms. Means for pivoting the latching arms around pivot points are provided and are located between the engaging ends and the actuator ends.

Spring arms are integrally formed with and cut out from the latching arms. The spring arms are connected with the latching arms adjacent the engaging ends and extend therefrom in the direction of the actuator ends. The spring arms each comprise a first segment located generally in a plane of the latching arms and a second segment which extends inwardly therefrom so that its end bears against the housing. The length of the spring arms is selected so that the latching arms may be pivoted about the pivot points by finger grasping pressure on the actuator ends, to thus either engage or disengage the engaging ends from a complementary electrical connector.

A plastic housing cover generally covers the housing. Apertures are provided in the housing cover to permit finger access to grasp the actuator ends of the latching arms.

Other objects, aspects and features of the present invention in addition to those mentioned above will be pointed out in detail or will be understood from the following detailed description provided in conjunction with the accompanying drawings.

DESCRIPTION OF THE PREFERRED EMBODIMENT

With reference to FIGS. 1–12, where like numbers indicate like elements in the Figures, an electrical connector 10 is shown. Connector 10 comprises a housing 20 and latching arms 50 along each lateral side of the housing 20.

Figures 1, 9:
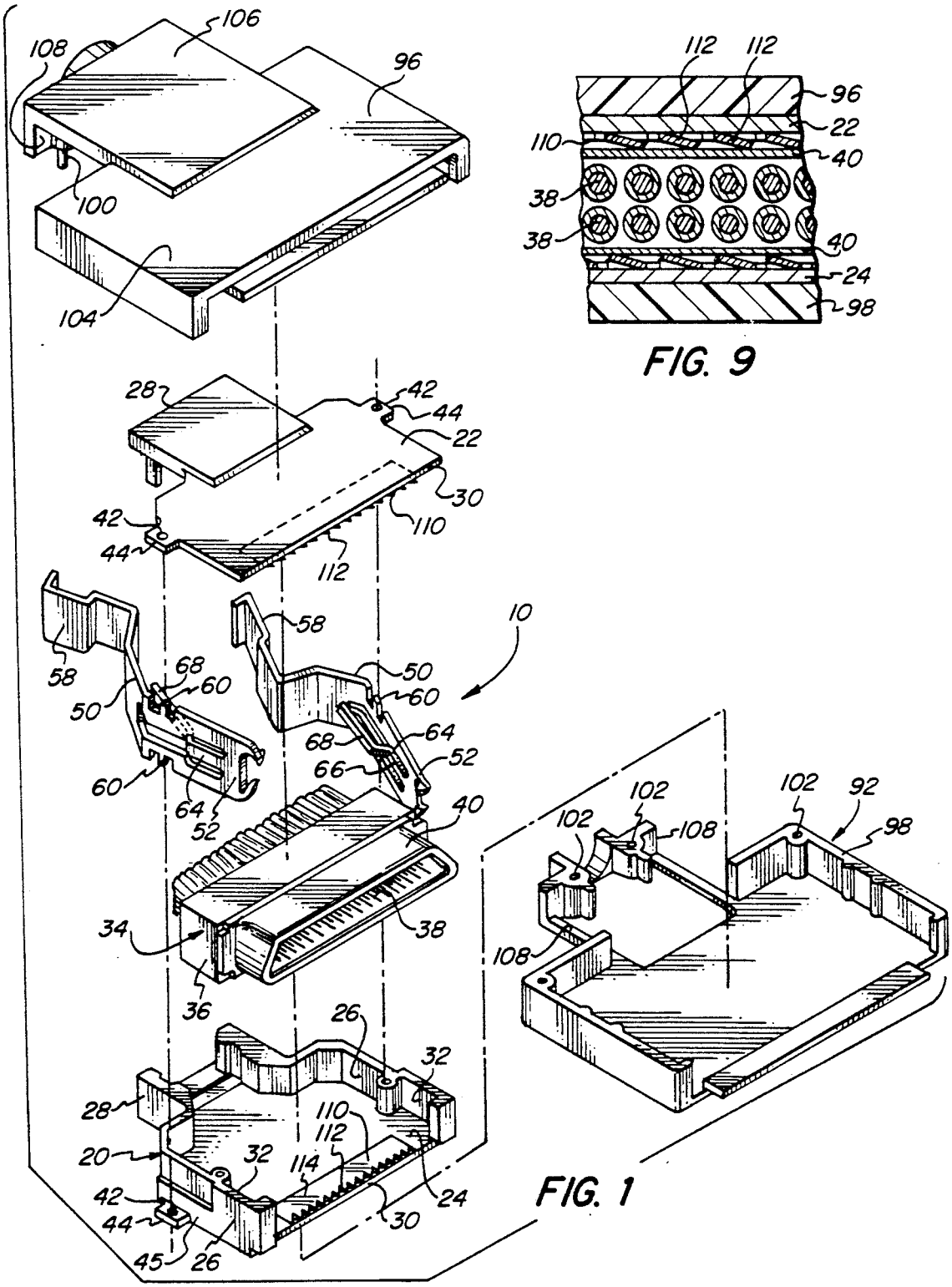
FIG. 1 is an exploded perspective view of an electrical connector in accordance with an embodiment of the invention.
FIG. 9 is a cross-sectional view of an electrical connector in accordance with an embodiment of the invention showing an electrical shielding member in shielding contact with the connector housing and a connector module.
Figure 2:
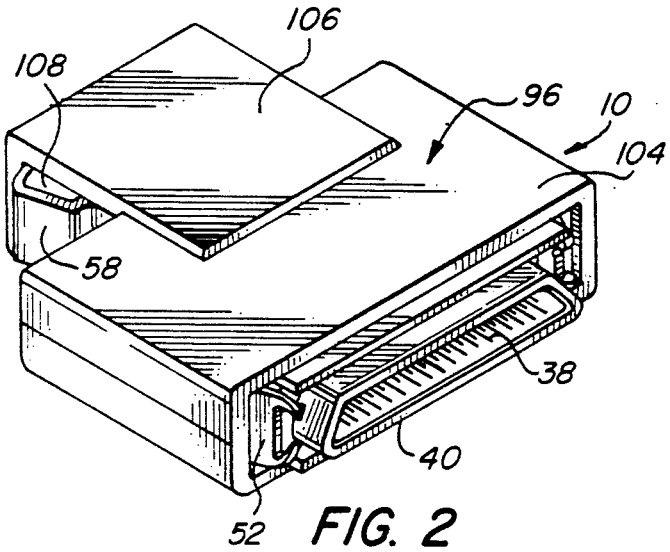
FIG. 2 is a perspective view of an electrical connector in accordance with an embodiment of the invention.
Figure 4:
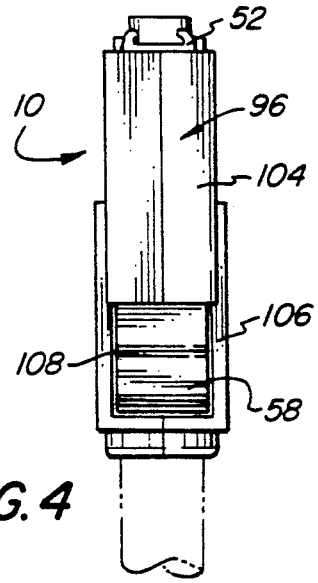
FIG. 4 is a side elevation view of the electrical connector of FIG. 2.
Figure 3:
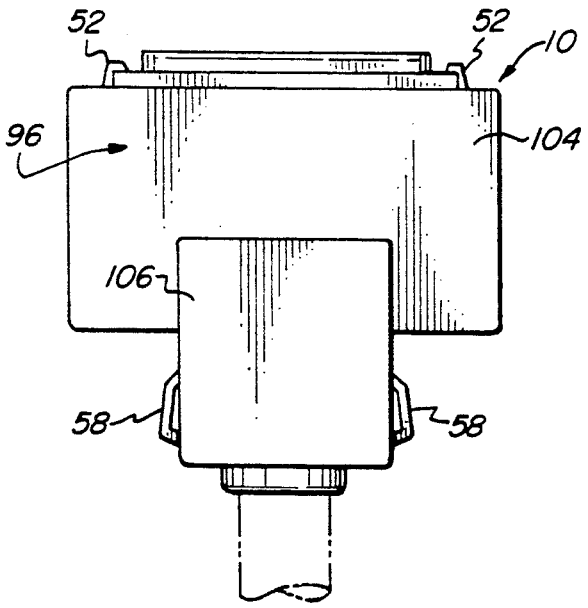
FIG. 3 is a top plan view of the electrical connector of FIG. 2.
Figure 5:
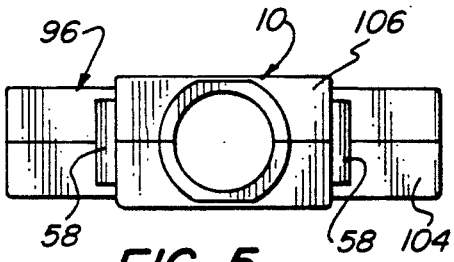
FIG. 5 is an end elevation view of a cable receiving end of the electrical connector of FIG. 2.
Figure 6:
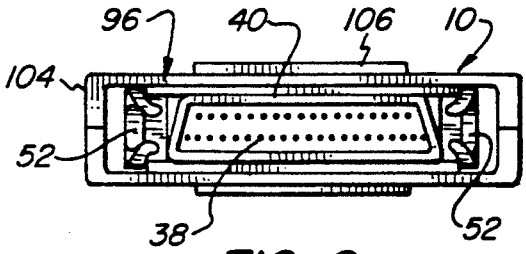
FIG. 6 is an end elevation view of a connector receiving end of the electrical connector of FIG. 2.
Figure 7:
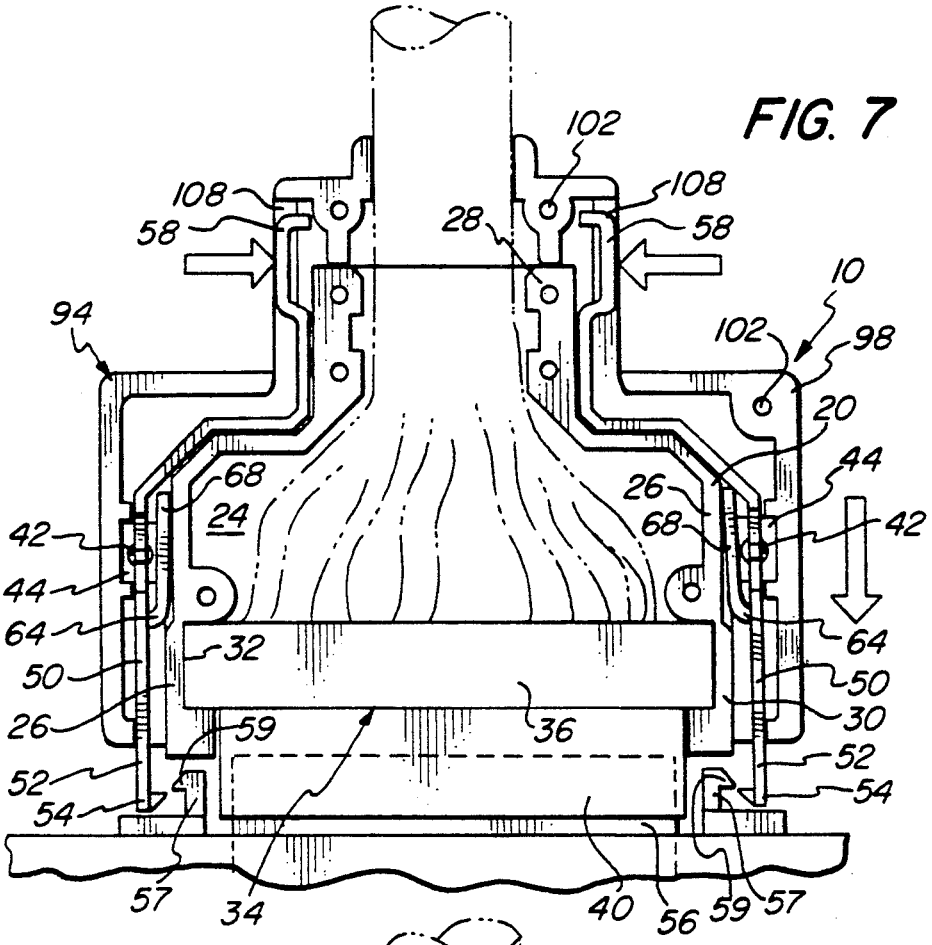
FIG. 7 is a top plan view of an electrical connector in accordance with an embodiment of the invention with portions of a connector housing and a housing cover removed to show the actuation of the latching arms prior to engagement with a complementary electrical connector.
Figure 8:
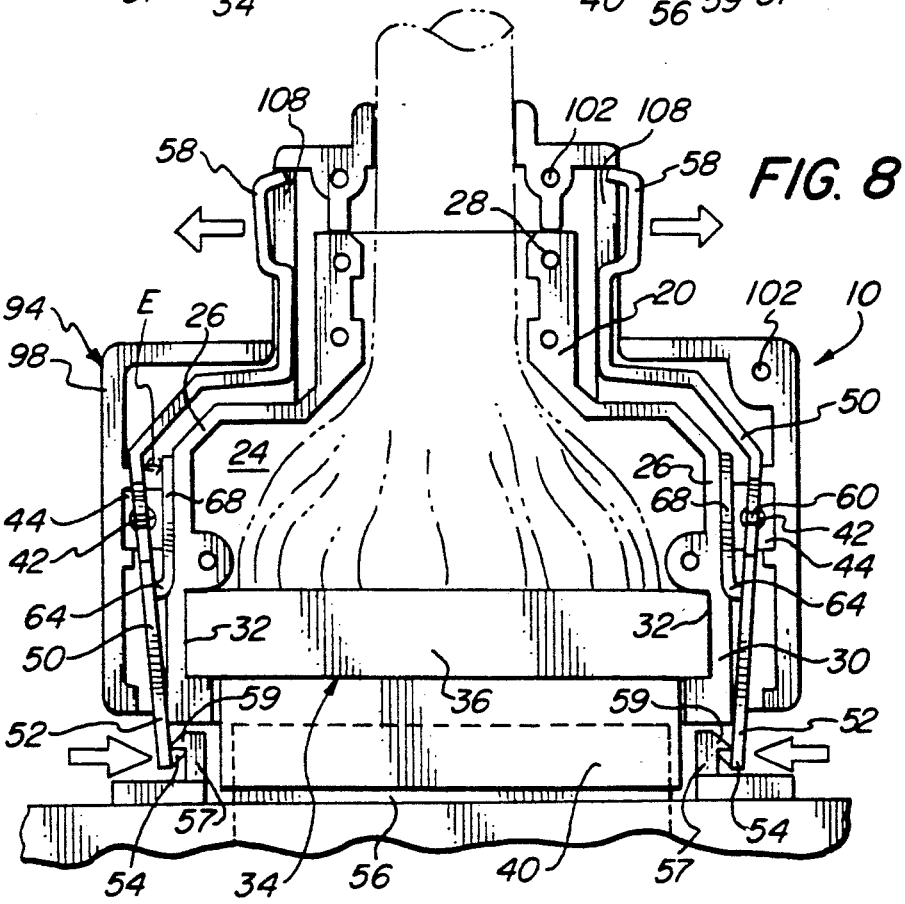
FIG. 8 is a top plan view of the electrical connector of FIG. 7 showing the engagement of the latching arms with a complementary electrical connector.

Referring particularly to FIGS. 1, 7 and 8, the housing 20 has an upper wall 22 and a lower wall 24. In the preferred embodiment of the invention, the housing 20 is preferably formed of die cast zinc. Preferably, the housing 20 has lateral side walls 26 integrally joined with the lower wall 24. Housing 20 has a cable receiving end 28 and a connector receiving end 30. The connector receiving end 30 has opposing channels 32 formed in side walls 26 for receiving a connector module 34. The connector module 34 comprises a plastic sleeve 36 for frictionally fitting into channels 32. Sleeve 36 has a plurality of pin elements 38 which are adapted to be connected to a plurality of wires. An electrically conductive barrel element 40 surrounds the pin elements 38. Cable receiving end 28 of housing 20 is adapted to receive and clamp onto coaxial shielded cable having a plurality of wires therein. The connector receiving end 30 has a greater width than the cable receiving end 28. The housing 20, and particularly the upper and lower walls 22 and 24 have a width that narrows from the connector receiving end 30 to the cable receiving end 28. The lateral side walls 26 conform with the changing width of the upper and lower walls 22 and 24.

Housing 20 has four pivot pin receiving apertures 42 formed in four tabs 44 extending laterally from the housing 20. Tabs 44 are located in the planes of the upper and lower walls 22 and 24. Preferably, tabs 44 extend from the wider portion 45 of the housing 20.

Referring particularly to FIGS. 1, 7, 8, 10 and 11, latching arms 50 have engaging ends 52 having hooking tabs 54 for engaging a complementary electrical connector 56, and actuator ends 58 for finger grasping to move the engaging ends 52 of the latching arms 50. Pivot pins 60 are provided to seat into the pivot pin receiving apertures 42 to permit pivoting of the latching arms 50 around the pivot points 62. The pivot pins 60 are preferably located between the engaging ends 52 and the actuator ends 58.

The latching arms 50 are generally shaped to conform with the lateral side walls 26, and the actuator ends 58 are located generally adjacent the cable receiving end 28 so that the actuator ends 58 may be finger grasped from the cable receiving end 28 of housing 20. Most preferably, the actuator ends 58 are located closely together so that an operator's fingers can grasp the actuator ends 58 within the width of the electrical connector 10, so that even where multiple connectors 10 are placed closely next to each other in stacks or rows, the latching arms 50 of the connectors 10 can be easily operated to engage or disengage the connector 10 from the complementary electrical connector 56.

Complementary connector 56 has two extending prongs 57. Each prong 57 has a hook element 59 located at one side of the prong 57, at positions selected so that the hook elements 59 can be engaged by the hooking tabs 54 of the latching arms 50.

Referring particularly to FIGS. 1, 7, 8, 10 and 11, spring arms 64 are integrally formed with and cut away from the latching arms 50. The spring arms 64 are connected with the latching arms 50 adjacent the engaging ends 52 and extend therefrom in the direction of the actuator ends 58. The spring arms 64 comprise a first spring arm segment 66 located in the plane of the latching arm 50 and a second spring arm segment 68 extending inwardly therefrom to bear against the housing 20. The spring arms 64 have a sufficient length to provide a spring resilience so that the latching arms 50 may be pivoted about the pivot points 62 by finger grasping pressure on the actuator ends 58 to engage or disengage the engaging ends 52 from the complementary electrical connector 56. Preferably, finger grasping pressure causes the engaging ends 52 to move laterally outwardly to release the engaging ends 52 from the complementary electrical connector 56.

Figure 10:
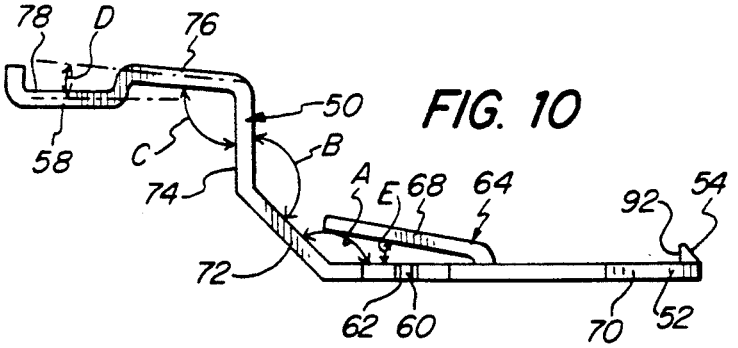
FIG. 10 is a top plan detail view of an embodiment of a latching arm of an electrical connector in accordance with an embodiment of the invention.
Figure 11:
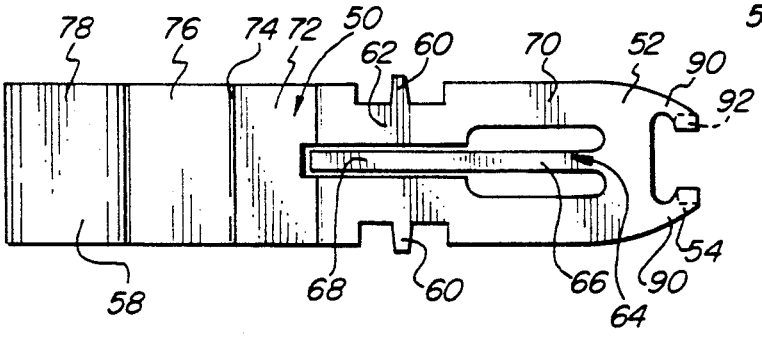
FIG. 11 is a side elevation detail view of the latching arm of FIG. 10.
Figure 13:
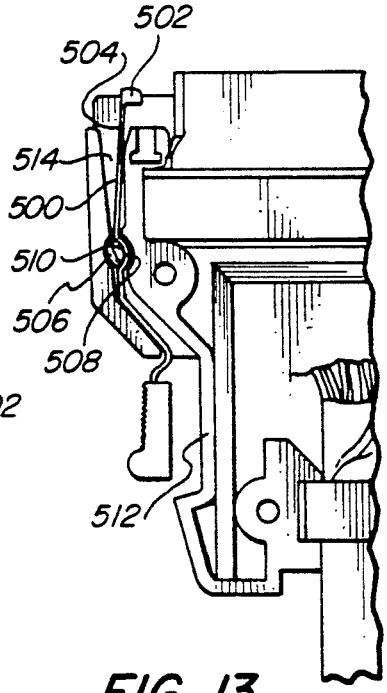
FIG. 13 (PRIOR ART)
FIG. 13 is a partial view of a prior art connector with a cover removed.

Referring now particularly to FIGS. 1, 10 and 11, in a preferred embodiment, the latching arms 50 comprise a first segment 70 extending straight from the hooking tabs 54 of the engaging end 52, a second segment 72 extending inwardly from the first segment 70 at an angle A of about 135 degrees, a third segment 74 extending inwardly from the second segment 72 at an angle B of about 135 degrees such that the third segment 74 is generally perpendicular to the first segment 70, a fourth segment 76 extending inwardly from the third segment 74 at an angle C of about 95 degrees, and a fifth segment 78 comprising the actuator end 58 extending outwardly from the fourth segment 76 at an angle D of about 5 degrees. In this preferred embodiment, the spring arms 64 extend from the first latching arm segment 70 in a zone adjacent the engaging end 52 to a beginning zone of the second segment 72. First spring arm segment 66 is located in a plane defined by the first latching arm segment 70, and second spring arm segment 68 extends inwardly from the first spring arm segment 66 at an angle E of about 15 degrees to bear against the housing 20.

The hooking tabs 54 preferably have tab first segments 90 extending from and in the same axis as the first segment 70 of the latching arms 50 and tab second segments 92 extending inwardly and generally perpendicularly from the tab first segments 90. The hooking tabs 54 are formed by stamping to bend over the tabs 54 to form the segments 90 and 92.

Referring now particularly to FIGS. 1–8, a housing cover 94 is provided. Housing cover 94 preferably comprises top and bottom halves 96 and 98 which are adapted to be secured together by interfitting pins 100 and pin receiving apertures 102. In visual appearance, housing cover 94 preferably comprises a larger rectangular segment 104 for covering the housing 20 and the latching arms 50 in the area of the connector receiving end 30, and a smaller rectangular segment 106 for covering the housing 20 and the latching arms 50 in the area of the cable receiving end 28. The smaller rectangular segment 106 is provided with rectangular apertures 108 for providing finger access to grasp the actuator ends 58 of the latching arms 50.

Referring particularly to FIGS. 1 and 9, a resilient conductive electrical shielding member 110 having a plurality of distributed tab elements 112 is preferably provided for electrically connecting the housing 20 and the connector module barrel element 40 to act as a distributed RF shield. The electrical shielding member 110 preferably comprises an electrically conductive strip 114 affixed to and in electrical contact with the housing 20. The tab elements 112 extend generally laterally and outwardly away from the strip 114. The tab elements 112 are generally rectangular elements creased diagonally from opposite corners of the rectangular tabs 112. Preferably, the resilient conductive electrical shielding member 110 consists essentially of a beryllium copper alloy.

The latching arms 50 are formed of relatively thick gauge metal, preferably steel having a thickness of about 0.040 inches, to prevent bending or deformation of the engaging ends 52. Similarly, the prongs 57 and hook elements 59 of the complementary connector 56 are formed of thick gauge metal of about the same thickness. The latching arms 50 are very strong, and are capable of retaining the electrical connector 10 to the complementary electrical connector 56 to resist separation forces of at least 50 pounds.

Figure 12:
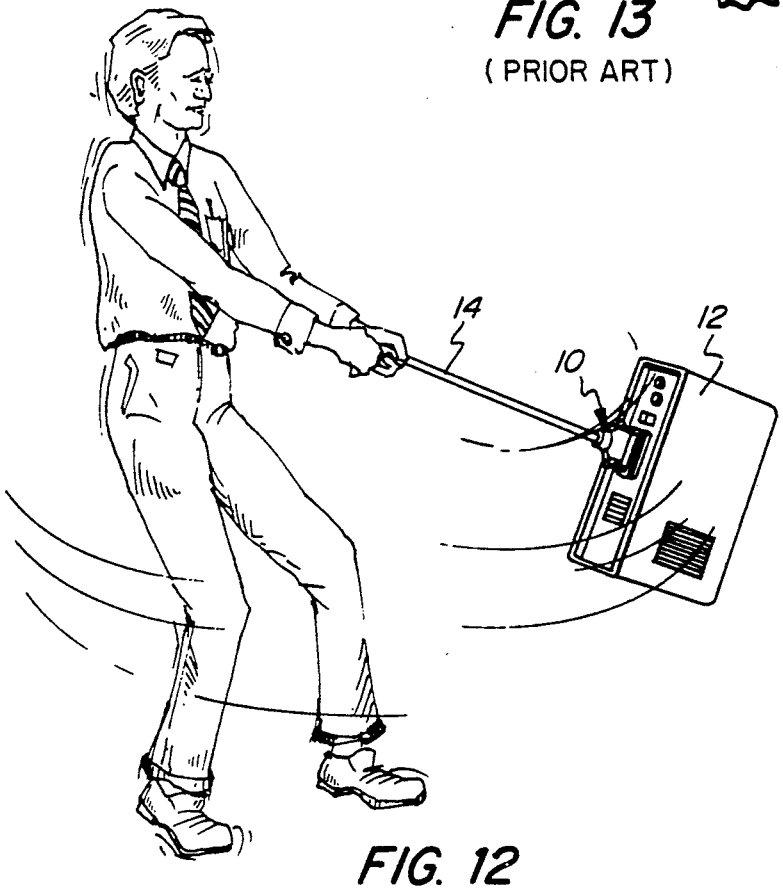
FIG. 12 is a demonstrative view of an embodiment of the electrical connector in accordance with the invention showing the high separation resistance of the latching arms.
Figure 14:
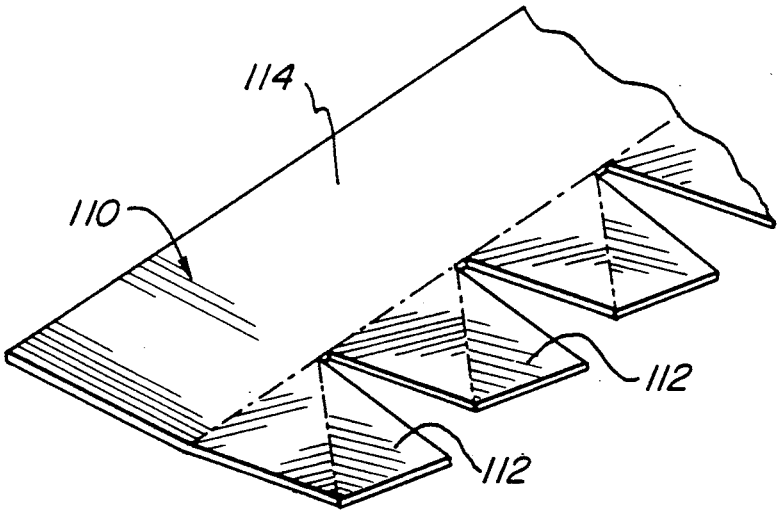
FIG. 14 is a detail view of the distributed tab elements of the electrical shielding member.

Referring now to FIG. 12, the strength of the cable connector was shown by the following demonstration. In this demonstration, the electrical connector 10 was secured to a complementary electrical connector on a workstation computer 12. The computer was then lifted by the cable 14 onto which the electrical connector 10 was mounted. The person performing the demonstration began turning around until centripedal forces caused the computer to extend outwardly from the person. The electrical connector 10 kept the cable 14 secured to the computer 12. Other tests have included yanking, pulling, and twisting of the cable 14. Despite substantial mechanical loading, the electrical connector 10 remains secured to the computer 12. Under high mechanical loads, the computer internal framework and/or casing is more likely to give way before the connector 10 releases.

The present invention therefore provides a novel and useful connector apparatus that is sturdy, yet easy to use. It is to be appreciated that the foregoing is illustrative and not limiting of the invention, and that the practitioner may also develop other embodiments all within the scope of the invention.

We claim:

1. An electrical connector for mating with a complementary electrical connector, comprising:

a housing having a cable receiving end and a connector receiving end and sides; and a latching arm located along at least one side of said housing, said latching arm being formed of relatively thick gauge metal to prevent bending and deformation of an engaging end thereof, and having said engaging end for engaging a complementary electrical connector, an actuator end for finger grasping to move said engaging end of said latching arm, means for pivoting said latching arm, a spring arm integrally attached to and cut out from said latching arm, said spring arm being connected with said latching arm adjacent said engaging end, said spring arm extending from said latching arm toward said actuator end to bear against said housing, said spring arm having a sufficient length to provide a spring resilience such that said latching arm may be pivoted about said pivot point by finger grasping pressure on said actuator end, to engage or disengage said engaging end from the complementary electrical connector.

2. An electrical connector in accordance with claim 1, wherein there are two of said latching arms, said two latching arms being located opposing each other on opposite sides of said housing.

3. An electrical connector in accordance with claim 2, wherein said engaging ends of said latching arms comprise hooking tabs having initial segments extending from said latching arms along an axis of said engaging end and ending segments extending inwardly and generally perpendicularly from said initial segments.

4. An electrical connector in accordance with claim 2, wherein said spring arms comprise first spring arm segments located generally in a plane where said first spring arm segments are connected to said latching arms, and second spring arm segments extending inwardly therefrom to bear against said housing.

5. An electrical connector in accordance with claim 2, wherein said spring arms have a spring resilience which is selected whereby said engaging ends of said latching arms are pivoted to engage a complementary electrical connector to prevent separation therefrom.

6. An electrical connector in accordance with claim 2 wherein said latching arms comprise steel having a thickness of at least about 0.040 inches.

7. An electrical connector in accordance with claim 2, further comprising a connector module for mounting in said connector receiving end of said housing, said module having an electrically conductive barrel element, and a resilient conductive electrical shielding member having a plurality of distributed tab elements for electrically connecting said housing and said connector module barrel element.

8. An electrical connector in accordance with claim 2, further comprising:

a housing cover, said cover generally comprising a larger rectangular segment for covering said housing and said latching arms in the area of said connector receiving end, and a smaller rectangular segment for covering said housing and said latching arms in the area of said cable receiving end, said smaller rectangular segment being provided with rectangular apertures for providing finger access to grasp said actuator ends of said latching arms.

9. An electrical connector in accordance with claim 2, wherein said engaging ends have a thickness sufficient whereby they will retain said electrical connector to a complementary electrical connector to resist separation forces of at least 50 pounds.

10. An electrical connector in accordance with claim 9, wherein said latching arms may be pivoted by finger grasping pressure on said actuator ends to thereby move said engaging ends laterally outwardly to thereby release said engaging ends from the complementary electrical connector.

11. An electrical connector in accordance with claim 2, where said connector receiving end has a greater width than said cable receiving end and said housing has upper and lower walls having a changing width from said connector receiving end to said cable receiving end, and said housing has lateral side walls that conform with said changing width of said upper and lower walls, and wherein said latching arms are generally shaped to conform with said lateral side walls, and said actuator ends are located generally adjacent said cable receiving end whereby said actuator ends may be finger grasped from said cable receiving end.

12. An electrical connector in accordance with claim 11, wherein said actuator ends are located closely together whereby said actuator ends may be easily finger grasped and operated within the width of said housing.

13. An electrical connector in accordance with claim 12, wherein said latching arms comprise first segments extending straight from said hooking tabs of said engaging ends, second segments extending inwardly from said first segments at an angle of about 135 degrees, third segments extending inwardly from said second segments at an angle of about 135 degrees such that said third segments are generally perpendicular to said first segments, fourth segments extending inwardly from said third segments at an angle of about 95 degrees, and fifth segments comprising said actuator end extending outwardly from said fourth segments at an angle of about 5 degrees.

14. An electrical connector in accordance with claim 13, wherein said spring arms extend from said first latching arm segments in zones adjacent said engaging ends to beginning zones of said second latching arm segments, and first spring arm segments are located generally in a plane defined by said first latching arm segments, and second spring arm segments extend inwardly from said first spring arm segments at an angle of about 15 degrees.

15. An electrical connector for mating with a complementary electrical connector, comprising:

a housing having a cable receiving end, a connector receiving end and lateral sides; and two latching arms, one of said latching arms being located along one lateral side of said housing, the other of said latching arms being located along another of said lateral sides of said housing, said latching arms being formed of relatively thick gauge metal to prevent bending and deformation of hooking tabs at the ends of said latching arms, whereby said hooking tabs are capable of retaining said electrical connector to a complementary electrical connector and to resist separation forces, said latching arms having engaging ends having said hooking tabs for engaging a complementary electrical connector, said hooking tabs having initial segments extending from and along an axis of said latching arms and ending segments extending inwardly and generally perpendicularly from said extending segments, actuator ends for finger grasping to move said engaging ends of said latching arms, means for pivoting said latching arms around pivot points, spring arms integrally formed with and cut away from said latching arms, said spring arms being connected with said latching arms adjacent said engaging ends, said spring arms extending therefrom towards said actuator ends for a length extending past said pivot points, said spring arms comprising first spring arm segments located in a plane of said latching arms where said latching arms and said first spring arm segments are connected, and second spring arm segments extending inwardly therefrom to bear against said housing in the vicinity of or past said pivot points, said spring arms having a length selected to provide a spring resilience such that said latching arms may be pivoted by finger grasping pressure on said actuator ends, to engage or disengage said engaging ends from the complementary electrical connector.

16. An electrical connector in accordance with claim 15, further comprising:

a housing cover, said cover generally comprising a larger rectangular segment for covering said housing and said latching arms in the area of said connector receiving end, and a smaller rectangular segment for covering said housing and said latching arms in the area of said cable receiving end, said smaller rectangular segment being provided with rectangular apertures for providing finger access to grasp said actuator ends of said latching arms.

17. An electrical connector in accordance with claim 16, wherein said latching arms comprise steel having a thickness of at least about 0.040 inches whereby said engaging ends of said latching arms may lockingly engage a complementary electrical connector to prevent separation therefrom at high separation forces.

18. An electrical connector in accordance with claim 17, wherein said latching arms comprise first segments extending straight from said hooking tabs of said engaging ends, second segments extending inwardly from said first segments at an angle of about 135 degrees, third segments extending inwardly from said second segments at an angle of about 135 degrees such that said third segments are generally perpendicular to said first segments, fourth segments extending inwardly from said third segments at an angle of about 95 degrees, and fifth segments comprising said actuator end extending outwardly from said fourth segments at an angle of about 5 degrees.

19. An electrical connector in accordance with claim 18, wherein said spring arms comprise first spring arm segments and second spring arm segments, and said spring arms extend from said first latching arm segments in zones adjacent said engaging ends to beginning zones of said second latching arm segments, and said first spring arm segments are located generally in a plane defined by said first latching arm segments, and said second spring arm segments extend inwardly from said first spring arm segments at an angle of about 15 degrees.

20. An electrical connector in accordance with claim 19, further comprising a connector module for mounting in said connector receiving end of said housing and a resilient conductive electrical shielding member having a plurality of tab elements electrically connecting said housing and said connector module.

21. An electrical connector for mating with a complementary electrical connector, comprising:

a housing having two lateral side walls and an upper and a lower wall, and a cable receiving end and a connector receiving end, said connector receiving end having a greater width than said cable receiving end whereby said upper and lower walls have a changing width from said connector receiving end to said cable receiving end, and whereby said lateral side walls conform with said changing width of said upper and lower walls, said housing having pivot pin receiving apertures formed in tabs extending laterally from said housing in the planes of said upper and lower walls;

a connector module for locating in said connector receiving end of said housing, said module having a plurality of pin elements, an electrically conductive barrel element surrounding said pin elements, and means for receiving a plurality of wires and connecting said wires to said pin elements;

two latching arms, one said latching arm being located along one lateral side wall of said housing, the other said latching arm being located along another lateral side wall of said housing, said latching arms being formed of relatively thick gauge metal to prevent bending or deformation of hooking tabs thereon and whereby said hooking tabs are capable of retaining said electrical connector to a complementary electrical connector and to resist separation forces of at least 50 pounds, said latching arms having engaging ends having said hooking tabs for engaging a complementary electrical connector, said hooking tabs having initial segments extending from and in the same axis as said latching arms and ending segments extending inwardly and generally perpendicularly from said extending segments, actuator ends for finger grasping to move said engaging ends of said latching arms, pivot pins located between said engaging ends and said actuator ends for fitting in said pivot pin receiving apertures for pivoting said latching arms, spring arms integrally formed with and cut away from said latching arms, said spring arms being connected with said latching arms adjacent said engaging ends thereof, said spring arms extending therefrom towards said actuator ends for a length extending past said pivot pins, said spring arms comprising first spring arm segments located in planes of said latching arms and second spring arm segments extending inwardly therefrom to bear against said housing in the vicinity of or past said pivot points, said spring arms having a sufficient length to provide a spring resilience such that each said latching arms may be pivoted about said pivot points by finger grasping pressure on said actuator ends to engage or disengage said engaging ends from the complementary electrical connector; and a housing cover, said cover having apertures for providing finger access to grasp said actuator ends of said latching arms.

22. An electrical connector in accordance with claim 21, wherein said latching arms comprise steel having a thickness of about 0.040 inches.

* * * * *